US007179069B2

(12) United States Patent
Grassbaugh

(10) Patent No.: US 7,179,069 B2
(45) Date of Patent: Feb. 20, 2007

(54) MOTOR COMPRESSOR LUBRICATION

(75) Inventor: Walter Grassbaugh, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 262 days.

(21) Appl. No.: 10/925,648

(22) Filed: Aug. 25, 2004

(65) Prior Publication Data

US 2006/0045784 A1 Mar. 2, 2006

(51) Int. Cl.
*F01C 1/02* (2006.01)

(52) U.S. Cl. ..... 418/55.6; 418/55.1; 418/94; 418/181

(58) Field of Classification Search ..... 418/55.1, 418/55.5, 55.6, 57, 94, 181
See application file for complete search history.

(56) References Cited

U.S. PATENT DOCUMENTS 4,331,420 A * 5/1982 Jones ..... 418/32
5,102,316 A 4/1992 Caillat et al.
5,370,513 A 12/1994 Fain
5,380,170 A 1/1995 Fain
5,591,018 A * 1/1997 Takeuchi et al. ..... 417/366
6,135,736 A 10/2000 Tucker, Jr. et al.
6,672,852 B1 * 1/2004 Chang et al. ..... 418/55.6
6,960,070 B2 * 11/2005 Kammhoff et al. ..... 418/55.6

FOREIGN PATENT DOCUMENTS

JP 61-008491 1/1986
JP 61-187591 8/1986

* cited by examiner

*Primary Examiner*—Hoang Nguyen
(74) *Attorney, Agent, or Firm*—Harness, Dickey & Pierce, P.L.C.

(57) ABSTRACT

A rotary machine is powered by a drive shaft having a bore extending through it. A single piece lubricant flinger is disposed within the bore to form a lubricant pump. The lubricant flinger includes an upper plate located within the bore and a washer located adjacent the opening of the bore. The washer is connected to the upper plate by a connection section and the washer defines an aperture which allows fluid to flow into the bore of the shaft.

8 Claims, 4 Drawing Sheets

MOTOR COMPRESSOR LUBRICATION

FIELD OF THE INVENTION

The present invention relates to oil distribution within a rotating machine. More particularly, the present invention relates to a unique oil flinger disposed with a bore of a drive shaft which pumps oil through the bore of the drive shaft to the various components of the rotating machine.

BACKGROUND AND SUMMARY OF THE INVENTION

For exemplary purposes, the unique oil flinger of the present invention will be described in association with a scroll machine. It is to be understood that it is within the scope of the present invention to utilize the unique oil flinger of the present invention with any device having a rotating shaft.

A class of machines exists in the art known as "scroll" machines for the displacement of various types of fluids. Such machines may be configured as an expander, a displacement engine, a pump, a compressor, etc., and the features of the present invention are applicable to any of these machines. For purposes of illustration, however, the disclosed embodiments are in the form of a hermetic refrigerant compressor.

The concept of a scroll compressor has been known for some time and it has been recognized as having distinct advantages. For example, scroll compressors have high isentropic and volumetric efficiency, and, hence, are relatively small and light weight for a given capacity. They are quieter and more vibration free than many compressors because they do not use large reciprocating parts (e.g., pistons, connecting rods, etc.) and because all fluid flow is in one direction with simultaneous compression in plural opposed pockets, there are less pressure-created vibrations. Scroll compressors also tend to have high reliability and durability because of the relatively few moving parts utilized and the relatively low velocity of movement between the scrolls. Scroll compressors which have axial and radial compliance to allow fluid leakage have an inherent forgiveness to fluid contamination.

Generally speaking, a scroll compressor comprises two spiral scroll wraps of similar configuration, each mounted on a separate end plate to define a pair of scroll members. The two scroll members are interfitted together with one of the scroll wraps being rotationally displaced 180° from the other. The compressor operates by orbiting one scroll member (the orbiting scroll member) with respect to the other scroll member (the fixed scroll member or the non-orbiting scroll member) to make moving line contacts between the flanks of the respective wraps, defining moving isolated crescent-shaped pockets of fluid. The spiral scroll wraps are commonly formed as involutes of a circle, and ideally there is no relative rotation between the scroll members during operation, i.e. the motion is purely curvilinear translation (i.e. no rotation of any line on the body). The fluid pockets carry the fluid to be handed from a suction zone located at the outer periphery of the scroll compressor where a fluid inlet is provided to a discharge zone located centrally in the scroll compressor where a fluid outlet is provided. The volume of a sealed pocket is continuously reduced as it moves from the suction zone to the discharge zone. At any one instant of time, there will be at least one pair of sealed pockets and where there are several pairs of sealed pockets at one time, each pair will have a different volume from the other pairs.

Two types of contacts define the fluid pockets formed between the scroll members. First, axially extending tangential line contacts are formed between the spiral wrap faces or flanks of the wraps caused by radial forces (flank sealing) and second, area contacts (tip sealing) caused by axial forces are formed between the plane edge surfaces (tips) of each wrap and the opposite end plate. For high efficiency, good sealing must be achieved for both types of contacts.

While scroll compressors have relatively few moving parts, lubrication for these moving parts is a necessity for the durability of the scroll compressor. In a low-side compressor, a portion of the lubrication is suction gas flow which is allowed to pick up the overspray of lubricant from the moving components of the compressor and circulate the lubricant throughout the compressor. Suction gas is baffled and routed through the compressor in such a way as to control the amount of lubricant that is picked up by the suction gas to a tolerable level for compressor operation at rated operating conditions. The lubricant which is picked up by the suction gas primarily lubricates the two contacts which define the fluid pockets (flank sealing and tip sealing).

The lubricant that is supplied to the other moving components and thus the sprayed lubricant that is picked up by the suction gas is supplied by a lubricant supply system which utilizes a lubricant sump located in the lower or bottom portion of the shell. The drive shaft extends into the sump to pump lubricant through a bore extending through the drive shaft to all of the various moving components of the compressor which require lubrication. Typically a lubricant flinger is disposed within the bore of the drive shaft and the bottom of the drive shaft rests on a thrust washer secured to the bearing housing rotatably supporting the drive shaft. The thrust washer includes a hole for the lubricant which is smaller than the bore supporting the lubricant flinger. The lubricant flinger and the thrust washer together as an assembly make up the lubricant pump which pumps the lubricant through the bore in the drive shaft to the moving components requiring lubrication.

While the above designed lubricant pump works well when the drive shaft is supported by the thrust washer, a problem arises when the design for the compressor supports the drive shaft in a different manner and thus, the thrust washer is not available as a component of the lubricant pump. While it may be possible to supply the thrust washer and its associated retention components solely for the purpose of creating the lubricant pump, this option is costly in both additional components as well as additional machining to accommodate these additional components.

The continued development of scroll compressors in general and lubrication systems in particular have been directed towards the design and simplification for the lubricant pump for the lubrication system.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
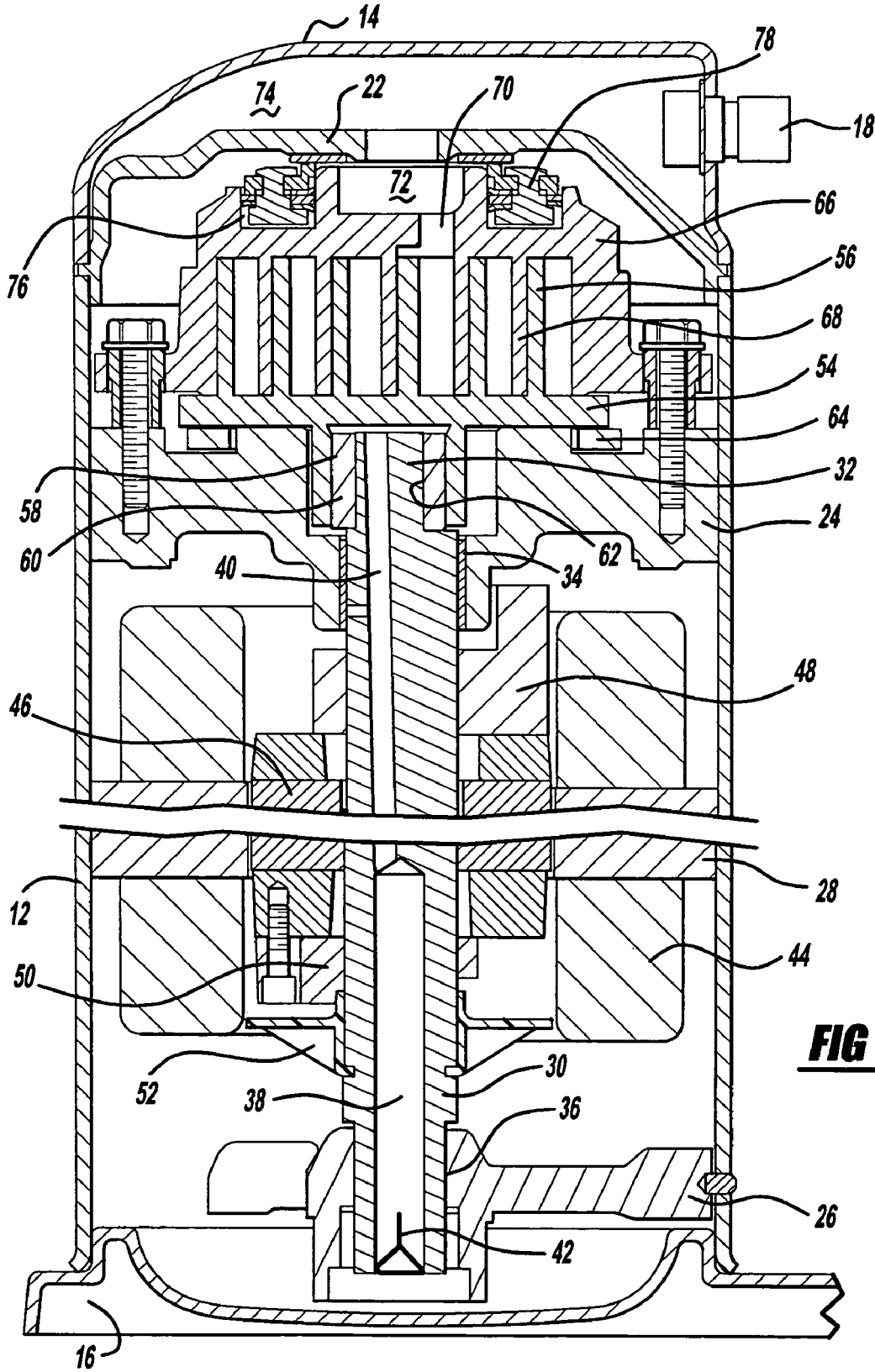
FIG. 1 illustrates a vertical cross-sectional view of a scroll compressor incorporating the lubricant flinger in accordance with the present invention.

There is illustrated in FIG. 1, a scroll compressor which incorporates the unique lubricant flinger in accordance with the present invention and which is designated generally by the reference numeral 10.

Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a stationary main bearing housing or body 24 which is suitably secured to shell 12, and a lower bearing housing 26 also having a plurality of radially outwardly extending legs, each of which is also suitably secured to shell 12. A motor stator 28, which is generally square in cross-section but with the corners rounded off, is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom the top of crankshaft 30. Disposed within bore 38 is a lubricant flinger 42. The lower portion of the interior shell 12 is filled with lubricating oil, and bore 38 in conjunction with lubricant flinger 42 acts as a pump to pump lubricating fluid up bore 38 in crankshaft 30 and into bore 40, and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor", the disclosure of which is hereby incorporated herein by reference.

The upper surface of main bearing housing 24 is provided with a flat thrust bearing surface on which is disposed an orbiting scroll member 54 having the usual spiral vane or wrap 56 on the upper surface thereof. Projecting downwardly from the lower surface of orbiting scroll member 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll member 54 and bearing housing 24 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506, the disclosure of which is hereby incorporated herein by reference, may be used in place thereof.

A non-orbiting scroll member 66 is also provided having a wrap 68 positioned in meshing engagement with wrap 56 of orbiting scroll member 54. Non-orbiting scroll member 66 has a centrally disposed discharge passage 70 communicating with an upwardly open recess 72 which is in fluid communication with a discharge muffler chamber 74 defined by cap 14 and partition 22. An annular recess 76 is also formed in non-orbiting scroll member 66 within which is disposed a seal assembly 78. Recesses 72 and 76 and seal assembly 78 cooperate to define axial pressure biasing chambers which receive pressurized fluid being compressed by wraps 56 and 68 so as to exert an axial biasing force on non-orbiting scroll member 66 to thereby urge the tips of respectively wraps 56, 68 into sealing engagement with the opposed end plate surfaces. Seal assembly 78 is preferably of the type described in greater detail in Assignee's U.S. Pat. No. 5,156,539, the disclosure of which is hereby incorporated herein by reference. Non-orbiting scroll member 66 is designed to be mounted with limited axial movement with respect to bearing housing 24 in a suitable manner such as disclosed in the aforementioned U.S. Pat. No. 4,877,382 or U.S. Pat. No. 5,102,316, the disclosure of which is hereby incorporated herein by reference.

Referring now to FIGS. 2–5 lubricant flinger 42 is illustrated in greater detail. Lubricant flinger 42 comprises an upper plate 90, and a washer 92. Upper plate 90 defines a positioning plate 94, a first angular plate 96 and a second angular plate 98

Figure 4:
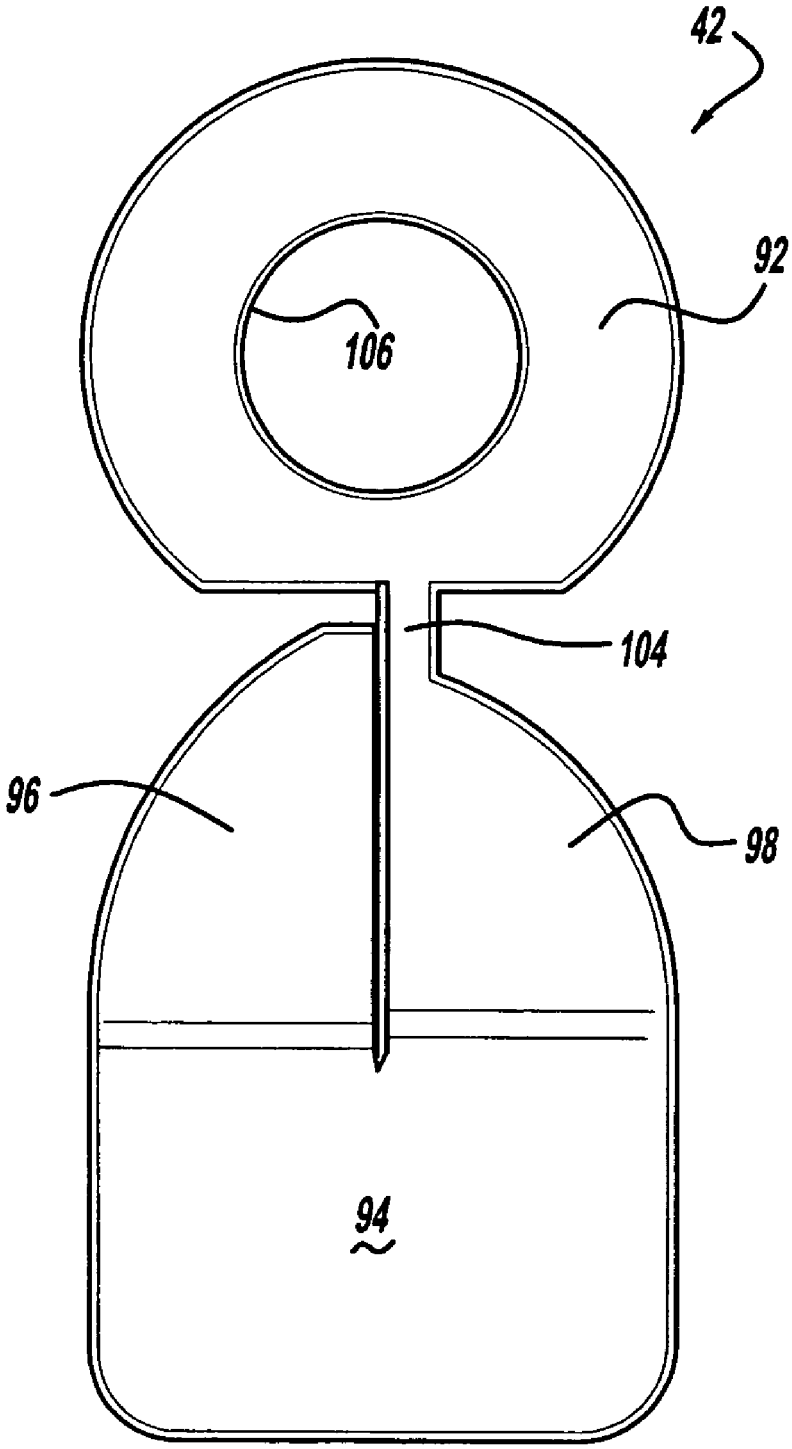
FIG. 4 is a plain view of the lubricant flinger illustrated in FIG. 3 prior to the forming of the lubricant flinger.

As illustrated in FIG. 4, upper plate 90 and washer 92 of lubricant flinger 42 are stamped from a flat piece of sheet metal as a single integral component. Upper plate 90 has a positioning plate 94 attached to a first angular plate 96 along a first fold line 100. Upper plate 90 has positioning plate 94 attached to second angular plate 98 along a second fold line 102. Second angular plate 98 is attached to washer 92 using a connecting link 104 to attach washer 92 to upper plate 90. The integral one piece design for lubricant flinger 42 enables lubricant flinger 42 to be manufactured form a simple stamping process.

Figure 5:
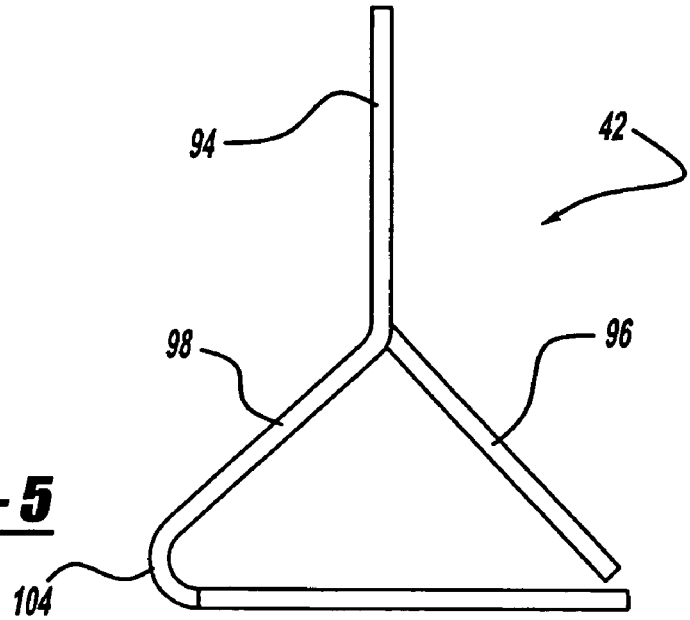
FIG. 5 is a side view of the lubricant flinger illustrated in FIG. 3.
Figure 3:
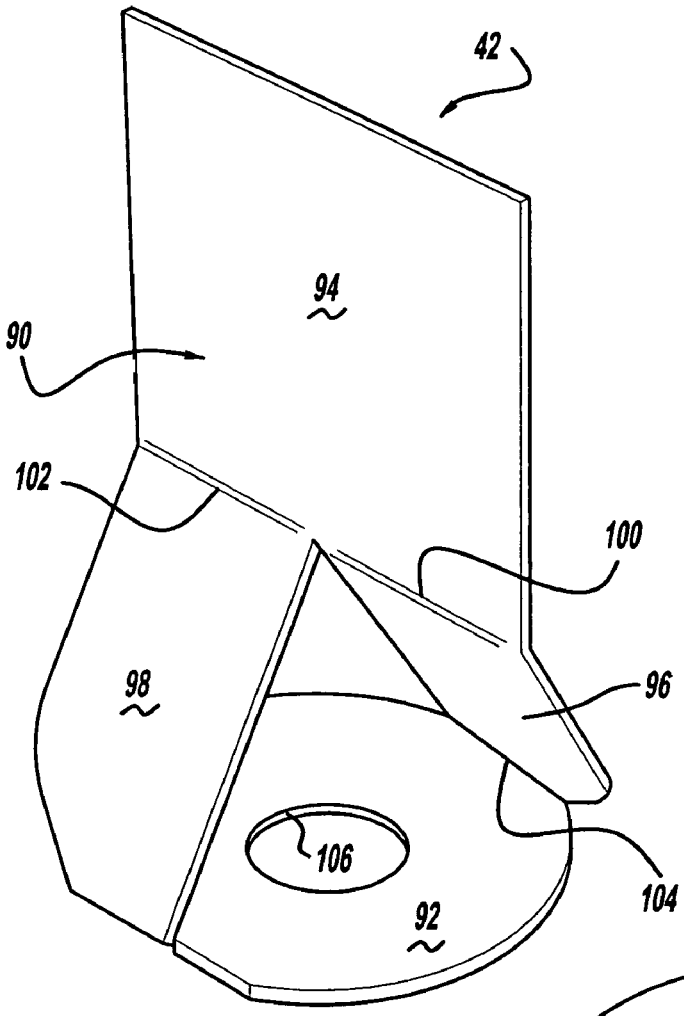
FIG. 3 is a perspective view of the lubricant flinger illustrated in FIGS. 1 and 2.
Figure 6:
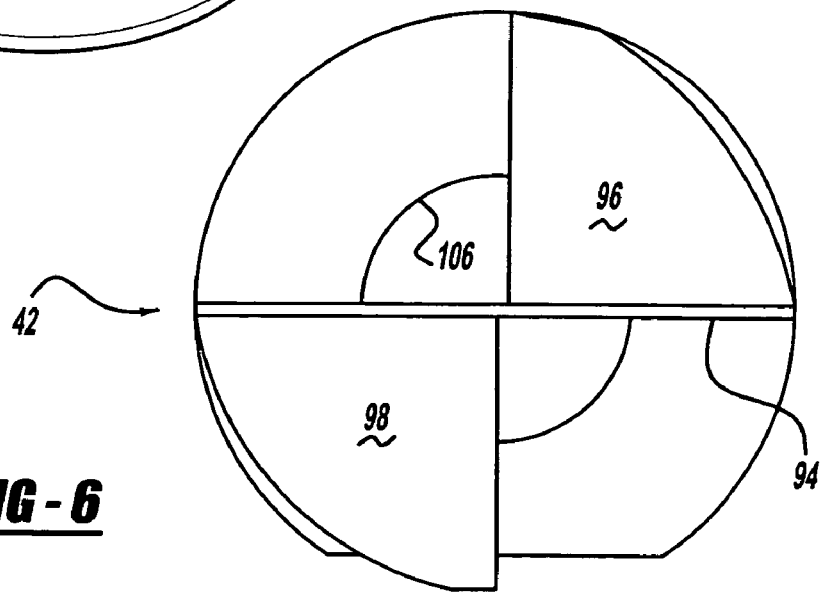
FIG. 6 is a top view of the lubricant flinger illustrated in FIG. 3.

Once stamped, lubricant flinger 42 is formed into the configuration illustrated in FIGS. 3, 5 and 6. First angular plate 96 is bent along first fold line 100 in a first direction, second angular plate 98 is bent along second fold line 102 in a second direction opposite to the first direction and washer 92 is bent at connection link 104 to a position where the plane of positioning plate 94 of upper plate 90 is generally perpendicular to the plane of washer 92.

Figure 2:
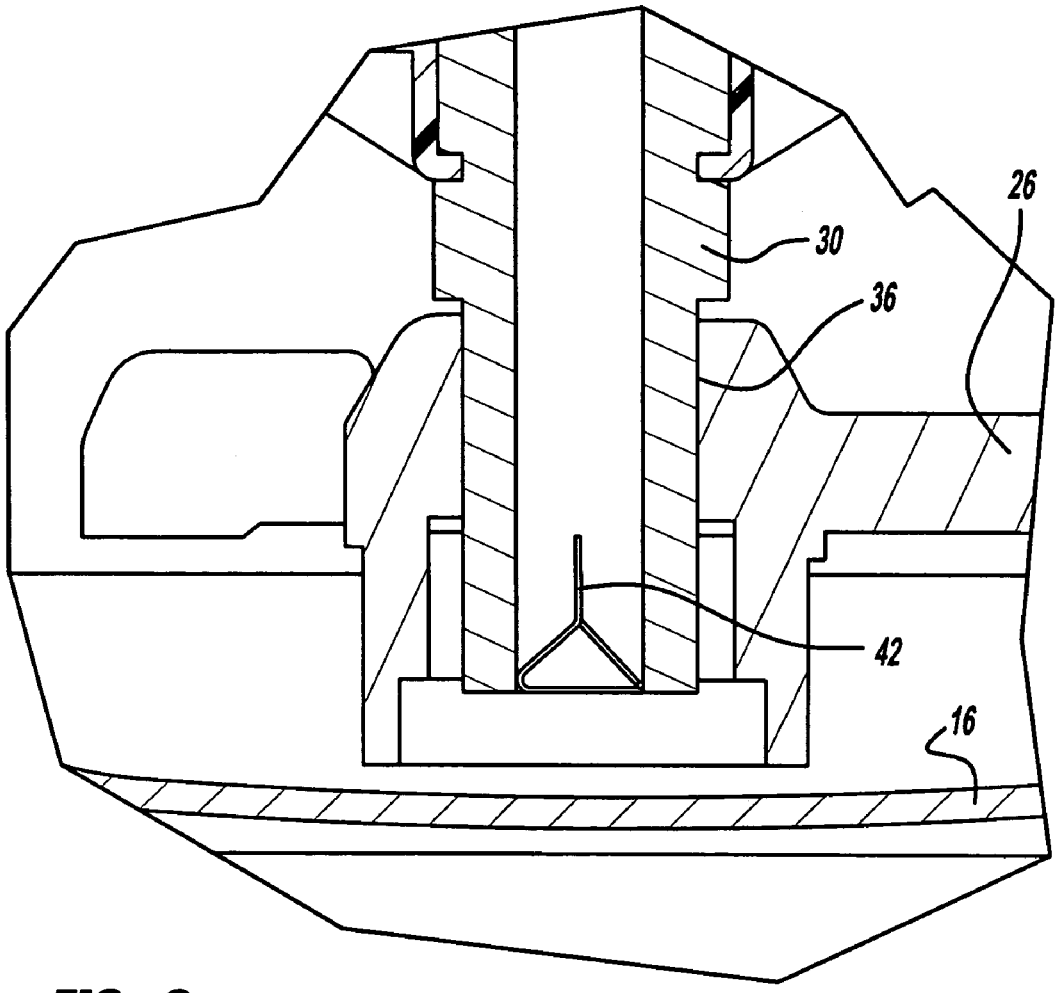
FIG. 2 is an enlarged cross-sectional view of the lower end of the drive shaft of the compressor illustrates in FIG. 1.

The formed lubricant flinger 42 is then pressed into large diameter bore 38 until washer 92 is located adjacent the opening of bore 38 as illustrated in FIG. 2. Washer 92 defines a centrally disposed aperture 106 which allows lubricant to move from the lower portion of shell 12 which is filled with lubricating oil into bore 38. Washer 92 performs the same function as the thrust washer in the prior art systems but washer 92 does not support crankshaft 30.

Upon rotation of crankshaft 30, lubricant which is located within bore 38 due to aperture 106 is pumped up bore 38 and into bore 40 and ultimately all of the various portions of compressor 10 which needs lubrication by lubricant flinger 42. Thus, lubricant flinger 42 disposed within bore 38 forms an oil pump for the lubrication of compressor 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus comprising:

a shell defining a lubricant sump;

a rotary machine disposed within said shell;

a drive shaft for powering said rotary machine, said drive shaft having a first end in engagement with said rotary machine and a second end disposed within said lubricant sump, said drive shaft defining a bore extending from said second end to said first end;

a monolithic lubricant finger disposed within said bore at said second end of said drive shaft, said lubricant finger including an upper plate, a first plate angularly extending downward from said upper plate toward said second end in a first direction, a second plate angularly extending downward from said upper plate toward said second end in a second direction opposite of said first direction, a washer defining an aperture for allowing lubricant to flow from said lubricant sump into said bore disposed adjacent an opening of said bore, and a connection link extending between said first plate or said second plate and said washer; and a drive member for rotating said drive shaft.

2. The apparatus according to claim 1 wherein said upper plate defines a first plane and said washer defines a second plane, said second plane being generally perpendicular to said first plane.

3. A compressor assembly comprising:

a shell defining a lubricant sump;

a compressor disposed within said shell;

a drive shaft for powering said compressor, said drive shaft having a first end in engagement with said compressor and a second end disposed within said lubricant sump, said drive shaft defining a bore extending from said second end to said first end;

a monolithic lubricant flinger disposed within said bore at said second end of said drive shaft, said lubricant finger including an upper plate, a first plate angularly extending downward from said upper plate toward said second end in a first direction, a second plate angularly extending downward from said upper plate toward said second end in a second direction opposite of said first direction, a washer defining an aperture for allowing lubricant to flow from said lubricant sum into said bore disposed adjacent an opening of said bore, and a connection link extending between said first plate said second plate and said washer; and a drive member for rotating said drive shaft.

4. The compressor apparatus according to claim 3 wherein said upper plate defines a first plane and said washer defines a second plane, said second plane being generally perpendicular to said first plane.

5. A scroll compressor comprising:

a shell defining a lubricant sump;

a first scroll member disposed within said shell, said first scroll member defining a first spiral wrap;

a second scroll member disposed within said shell, said second scroll member defining a second spiral wrap in interengaging relationship with said first spiral wrap so that as said first scroll member orbits with respect to said second scroll member, moving pockets of changing volume are formed by said wraps;

a drive shaft disposed within said shaft for causing said scroll members to orbit with respect to one another, said drive shaft having a first end in engagement with one of said scroll members and a second end disposed within said lubricant sump, said drive shaft defining a bore extending from said second end to said first end;

a monolithic lubricant finger disposed within said bore at said second end of said drive shaft, said lubricant finger including an upper plate, a first plate angularly extending downward from said upper plate toward said second end in a first direction, a second plate angularly extending downward from said upper plate toward said second end in a second direction opposite of said first direction, a washer defining an aperture for allowing lubricant to flow from said lubricant sump into said bore disposed adjacent an opening of said bore, and a connection link extending between said first plate or said second plate and said washer; and a drive member for rotating said drive shaft.

6. The scroll compressor according to claim 5 wherein said upper plate defines a first plane and said washer defines a second plane, said second plane being generally perpendicular to said first plane.

7. A lubricant pump comprising:

a shaft defining a bore; and a monolithic lubricant finger disposed within said bore at said second end of said drive shaft, said lubricant finger including an upper plate, a first plate angularly extending downward from said upper plate toward said second end in a first direction, a second plate angularly extending downward from said upper plate toward said second end in a second direction opposite of said first direction, a washer defining an aperture for allowing lubricant to flow from said lubricant sump into said bore disposed adjacent an opening of said bore, and a connection link extending between said first plate or said second plate and said washer.

8. The lubricant pump according to claim 7 wherein said upper plate defines a first plane and said washer defines a second plane, said second plane being generally perpendicular to said first plane.

* * * * *